US009469154B2

(12) United States Patent
Chen

(10) Patent No.: US 9,469,154 B2
(45) Date of Patent: Oct. 18, 2016

(54) ADHESIVE NOTEPAD

(76) Inventor: Albert Chen, Los Angeles, CA (US)

( * ) Notice: Subject to any disclaimer, the term of this patent is extended or adjusted under 35 U.S.C. 154(b) by 883 days.

(21) Appl. No.: 13/152,312

(22) Filed: Jun. 3, 2011

(65) Prior Publication Data

US 2012/0306188 A1 Dec. 6, 2012

(51) Int. Cl.

| | |
|---|---|
| ***B43L 1/00*** | (2006.01) |
| ***B44F 11/00*** | (2006.01) |
| *B42D 5/00* | (2006.01) |

(52) U.S. Cl.

CPC ..... *B44F 11/00* (2013.01); *B43L 1/00* (2013.01); *B42D 5/00* (2013.01); *B42D 5/003* (2013.01)

(58) Field of Classification Search

USPC ..... 428/40.1, 42.1; D19/6, 52

See application file for complete search history.

(56) References Cited

U.S. PATENT DOCUMENTS

| | | | | |
|---|---|---|---|---|
| 5,302,649 | A * | 4/1994 | Sasaki et al. | 524/274 |
| 2002/0077420 | A1* | 6/2002 | Chiba et al. | 525/89 |
| 2003/0006603 | A1* | 1/2003 | Pontecorvo | 281/31 |
| 2003/0008095 | A1* | 1/2003 | Meccia | 428/40.1 |
| 2008/0053610 | A1* | 3/2008 | Schneider | 428/40.1 |

OTHER PUBLICATIONS

CTO International (Jun. 2009) http://web.archive.org/web/20090602032535/http://www.chinawholesalegift.com/Office-Stationery-Gifts/WHITE-BOARD/white-board-173939866.htm.*

* cited by examiner

*Primary Examiner* — Kyle Grabowski
(74) *Attorney, Agent, or Firm* — Frank Marino

(57) ABSTRACT

A flexible adhesive notepad has a tacky elastomeric layer made of a naphthenic oil-impregnated thermoplastic rubber, and a face layer made of a polymer film permanently adhered to the elastomeric layer by an oil-based adhesive. The face layer has graphics to emulate a notebook. The graphics include an image of a blank sheet of a bound notebook. The face layer and elastomeric layer have a common periphery that emulates a notebook. The periphery has the shape of a bound notebook.

16 Claims, 1 Drawing Sheet

ADHESIVE NOTEPAD

FIELD OF THE INVENTION

The present invention is generally related to notepads. More specifically, the field of the invention as embodied in the present disclosure is related to a notepad that is adhesive to most surfaces, removable there-from without leaving residue behind, and reusable, especially such a notepad which can be written on and wiped clean for repeated note-taking. Even more specifically, the field of the invention as embodied in the present disclosure is related to a notepad that is shaped as and has graphics that emulate the lined pages of a bound notebook to give a "first glance" indication to potential note-takers that the device is for such note-taking.

BACKGROUND

Note pads and writing tablets are well known, but include numerous drawbacks and disadvantages. "Dry erase" tablets are a form of writing tablet popularly used at business meetings and such, in conjunction with a "dry erase" marker, wherein notes and diagrams can be made on the tablet's glossy and usually white face, and then completely and effortlessly removed with a simple wiping. Disadvantages of such tablets include their high cost to manufacture, heaviness, and lack of portability. As so far embodied, such tablets require either easels for support or hanging hardware for mounting to a wall and are not adaptable for simple and temporary affixation to such common household vertical surfaces as a refrigerator front, a kitchen cabinet, or even a wall, without using tools fastening hardware and causing installation damage. Hence, "dry erase" tablets are heretofore not practically capable of such household uses or uses in similar environments, and are not practical for simple movement from and adherence to one surface, and then another, as needed.

Magnet-backed devices, such as the notepad-including device described in U.S. Pat. No. 6,364,126, allow for temporary and removable affixation to refrigerator doors and similar ferritic surfaces. But their limitation to adherence to such ferritic surfaces reduces their usefulness, especially as even refrigerator doors are more frequently being made of non-ferritic materials. Such devices are also not sufficiently suggestive of such a note-taking capability, leaving potential note-takers scrambling to look for paper or such to write on without considering the capability of writing on the device.

Bound and loose-leaf notebooks are very popular and traditional items for recording notes. Few high school or college students are without a blank spiral-bound notebook at the start of a new course, waiting to be filled with course notes. While the outside "packaging" of such items vary greatly, including numerous designs and coverings, the appearance of the blank sheet of an opened bound or loose-leaf notebook is very familiar, and such an appearance invites and naturally suggests the purpose of note-taking. FIG. 5 of U.S. Pat. No. 6,682,248 shows a typical comb-bound notebook in such an open position. FIG. 3 of U.S. Pat. No. 2,252,783 shows a typical 3-ring loose-leaf notebook in such an open condition. Few would not immediately recognize that such a device in such a configuration is meant to be the recipient of written notes and reminders. Other notebooks are bound either permanently or in a refillable manner by such bindings as, but not limited to, various pluralities of openable or unopenable rings, helically-wound wiring, or tear-away spines. The key to the suggestion and invitation to use the device for note taking lies in the combination of at least a rectangular mostly-blank page with a hinge-type binding along the left or top edge.

There exists a need for improvement in the versatility of notepads, and such is an object of the present invention. There exists a need for added convenience in the use of notepads, and such is an object of the present invention. There exists a need for improved attachment to a variety of surfaces by notepads, and such is an object of the present invention. There exists a need for improved removal from those surfaces and reuse in notepads, and such is an object of the present invention. There exists a need for elimination of residue left when such notepads are removed from such surfaces, and such is an object of the present invention. There exists a need for a more suggestive appearance in such notepads to better suggest their intended use and invite such use, and such are objects of the present invention. Further needs and objects exist which are addressed by the present invention, as may become apparent by the included disclosure of an exemplary embodiment thereof.

SUMMARY OF THE INVENTION

The invention may be embodied as an adhesive-backed notepad that may be shaped as and may have graphics that emulate the lined pages of a bound notebook to give a "first glance" indication to potential note-takers that the device is for such note-taking. The notepad may be adhesive-backed by an oil-enhanced thermoplastic rubber polymer material, or similar material, to provide adherence to a multitude of various surfaces, to be removable there-from without leaving residue behind, and for a virtually infinite number of future re-adherences to other surfaces. The notepad may include a face made of a non-absorbent and solvent-resistant material to allow for simple and complete dry-erasing of notes written thereon.

The invention may be embodied in a notepad having an adhesive layer made of an oil-impregnated thermoplastic rubber, and a face layer permanently adhered to the adhesive layer and having a planar outer dry-erase surface. The face layer may have graphics to emulate a notebook. The face layer may have a periphery shaped to emulate the notebook. Or the adhesive layer and face layer may have a common periphery shaped to emulate the notebook. The dry-erase surface may be made of a polymer film from the group of materials including polycarbonate, polyethylene, and polyethylene-terephthalate. The thermoplastic rubber may be from the group including styrene thermoplastic elastomer, styrene-butadiene-styrene block copolymer, and styrene-ethylene-butadiene-styrene block copolymer. The impregnating oil may be from the group including hydrogenated naphthenic oil, mineral oil, and a combination of hydrogenated naphthenic oil and mineral oil. The adhesive layer may comprise one-hundred parts thermoplastic rubber by weight, one-hundred to three-hundred parts hydrogenated naphthenic oil by weight, one-hundred to three-hundred parts mineral oil by weight, less than ten parts petroleum tackifier resin by weight, and one to five parts polypropylene resin by weight.

The invention may alternatively be embodied in a flexible adhesive notepad having a tacky elastomeric layer made of a naphthenic oil-impregnated thermoplastic rubber, and a face layer made of a polymer film permanently adhered to the elastomeric layer by an oil-based adhesive. The face layer may have graphics to emulate a notebook. The graphics may include an image of a blank sheet of a bound notebook.

The invention may alternatively be embodied in a flexible adhesive notepad having a tacky elastomeric layer made of a naphthenic oil-impregnated thermoplastic rubber, and a face layer made of a polymer film permanently adhered to the elastomeric layer by an oil-based adhesive. The face layer and elastomeric layer may have a common periphery that emulates a notebook. The periphery may have the shape of a bound notebook.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings showing the representative embodiment of the accompanying Detailed Description. The components in the drawings are not necessarily to scale, emphasis instead being placed upon clearly illustrating the principles of the invention. Moreover, in the drawings, like reference numerals designate corresponding parts throughout the several views.

DETAILED DESCRIPTION OF A REPRESENTATIVE EMBODIMENT

Figure 2:
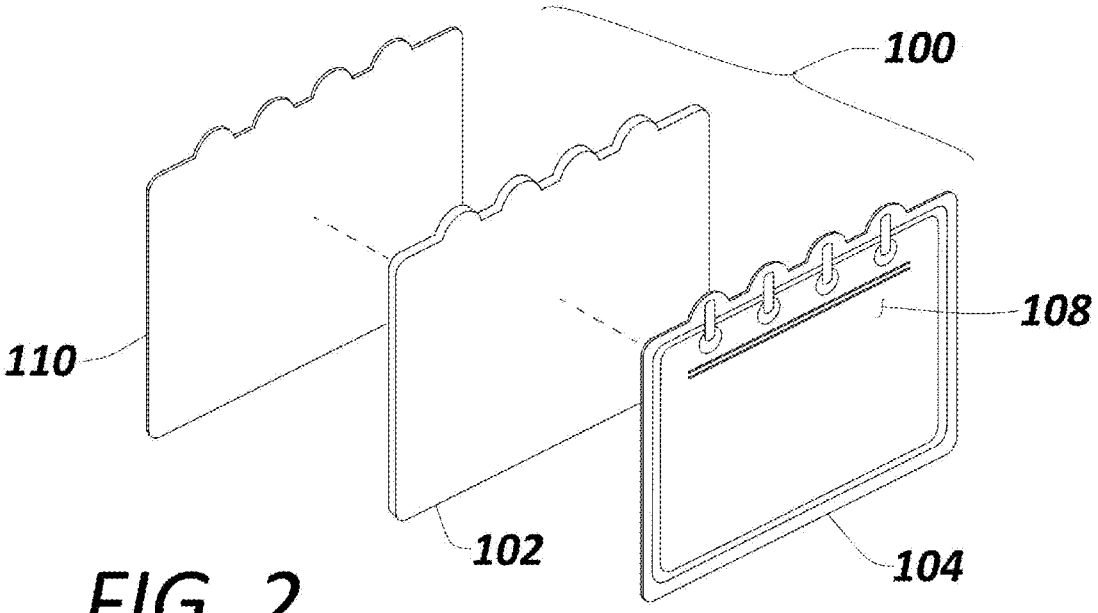
FIG. 2 is an exploded view of the notepad of FIG. 1.
Figure 3:
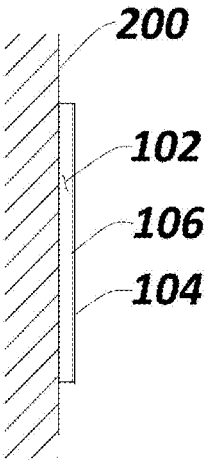
FIG. 3 is a side view of the notepad of FIG. 1, adhered to a vertical surface.
Figure 1:
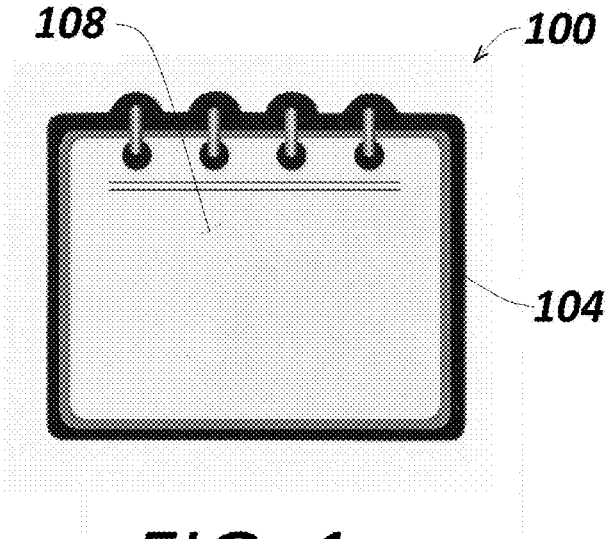
FIG. 1 is a face view of a notepad according to an exemplary embodiment of the invention.

An adhesive-backed notepad 100 exemplary of the invention is shown in FIGS. 1-3. The pad comprises an adhesive layer 102, a face layer 104, and a backing sheet 110. The notepad is shown in FIG. 3 with its backing sheet removed and its adhesive layer adhered to an arbitrary vertical surface 200.

As seen best in FIG. 1, the note pad is shaped to emulate a bound notebook. The graphics 108 on the face layer emulate the image of the notebook to make obvious at first glance that the device is intended for having notes written thereon.

The adhesive layer is preferably made of a homogenous oil-enhanced thermoplastic rubber polymer material (TPR). The preferred material is further described below, but a myriad of similar materials may be substituted therefore, so long as those provide equivalent adherence and removal performance. The face layer is permanently bound to the adhesive layer, preferably by an oil-based adhesive coating 106 there-between.

The backing sheet is preferably a wax or silicone impregnated paper material or a plastic film that removably adheres to the adhesive layer equivalently to the intended adherence of the adhesive layer to other surfaces, so that the backing sheet can be applied at manufacturing and can protect the adhesive layer during shipping, and can then be easily peeled from the adhesive layer prior to sticking the adhesive layer to a surface. No glue is used between the backing sheet and adhesive layer, so that the backing layer adheres to the adhesive layer by the adhesive properties of the adhesive layer only, and is easily peelable there-from. PET, PP, and PE films are found to be acceptable materials for the backing sheet. The backing sheet is removed and disposed of just prior to adhering the notepad to an intended surface.

The face layer is preferably made of a polymer film that is non-absorbent and non-staining, and at least reasonably solvent-resistant, to allow for simple and complete dry-erasing of notes written thereon. Polycarbonate (PC) film is preferred for its anti-scratching attributes. Poly-vinyl-chloride (PVC). Polyethylene (PE), Polypropylene (PP) or Polyethylene-terephthalate (PET) films are acceptable alternatives.

The face layer is permanently imprinted with graphics that emulate a predominantly blank page of a notebook. As disclosed, the face layer has thereon an image of a top bound 3-ring binder opened to a blank page. Images to emulate other forms of notebook or notepad may be substituted, such as but not limited to a 5-ring book, a comb-bound book, or a side-bound book. The goal is to give a "first glance" suggestion to a potential note-taker that the notepad is meant for having notes written there-on.

As earlier stated, the adhesive layer is preferably a thermoplastic rubber (TPR), and most preferably a styrene thermoplastic elastomer (STPE) version of a TPR, such as a styrene-butadiene-styrene block copolymer (SBS) or a styrene-ethylene-butadiene-styrene block copolymer (SEBS). This preferably homogenous layer of thermoplastic material is impregnated with a hydrogenated naphthenic oil for its permanent tackiness.

As an example, the adhesive layer may be comprised of one-hundred parts SEBS by weight, one-hundred to three-hundred parts hydrogenated naphthenic oil by weight, one-hundred to three-hundred parts white (mineral) oil by weight, less than ten parts petroleum tackifier resin by weight, and one to five parts PP resin by weight. Such SEBS may be Kraton Polymers LLC G series, or China Yueyang Baling Petrochemical Co., Ltd. Huaxing YH series, or some equivalent. Alternatively, an acceptable SBS may be Kraton Polymers LLC D series, or some equivalent.

The hydrogenated naphthenic oil preferably constitutes one-hundred-fifty to three hundred parts of the adhesive layer by weight, more preferably two-hundred to two-hundred-eighty parts by weight. This oil may be PetroChina Karamay Petrochemical Company's KNH series or NK series, or some equivalent.

The white (mineral) oil preferably constitutes one-hundred-fifty to three hundred parts of the adhesive layer by weight, more preferably two-hundred to two-hundred-eighty parts by weight.

The petroleum tackifier resin may be for example, C9 petroleum resin, C5 petroleum resin, C5/C9 copolymerized petroleum resin, or double glutaric thin (DCPD) resin. The tackifier resin preferably constitutes less than ten parts of the adhesive layer by weight, more preferably three to eight parts.

The PP resin may be improved by the addition of additives, including but not limited to plasticizers (such as paraffin or PE oligomers), antioxidants (such as calcium carbonate or silica), light stabilizers and UV stabilizers (such as UV-P and UV-320). These additives preferably constitute four to eight parts of the adhesive layer by weight.

Preferably, the adhesive strength of the adhesive layer is between 0.1 and 0.6 N/cm, the layer thickness is between 0.1 and 2.0 mm, and material has a Shore A hardness of less than 20 degrees. This adhesive can be reused many times without damage to its viscosity or reduction in its inherent adhesion. Removal of the notepad by peeling the adhesive layer and face layer from the surface to which it has been mounted does not leave any discernable adhesive residue on the surface.

In addition, the adhesive layer is easy to clean, with the dust and other impurities needing only to be wiped off with a damp cloth.

In use, the note-taker simply writes notes and reminders within the blank area of the face layer, and after those notes or reminders have served their purpose, they can be wiped away, leaving a fresh and virtually new blank face layer for future note-taking. The writing is preferably done using a typical "dry erase" marker. It is found, however, that other forms of more permanent ink may still be wiped from the face layer, especially when the wiping device is treated with alcohol.

It is found that those completely unfamiliar with the device are instantly disposed to use it properly when confronted with the need for note-taking. Users who have available numerous other means for recording their notes are found to consistently recognize this device as being a place to write down notes. It is found to be far superior in that regard to an identically constructed and equivalently dimensioned plain white and plain rectangular version.

Additional embodiments of the invention may be made to emulate in graphics and/or shape such other types of notepads as a calendar, a shopping list, a phone number list, or other such familiar items, all of which are within the invention.

While the invention has been shown and described with reference to a specific exemplary embodiment, it should be understood by those skilled in the art that various changes may be made thereto without sacrificing its material advantages. Various changes in form and detail may be made without departing from the spirit and scope of the invention, and the invention should therefore only be limited according to the following claims, including all equivalent interpretation to which they are entitled.

I claim:

1. A notepad comprising:

an adhesive layer comprised of an oil-impregnated thermoplastic rubber having a thickness from 0.5 mm to 2.0 mm;

a face layer permanently adhered to the adhesive layer and having a planar outer dry-erase surface, the face layer comprising graphics which indicate a plurality of evenly spaced holes adjacent one edge thereof and which indicate a plurality of binder rings inserted through said holes to emulate a bound notebook; and the adhesive and face layers together comprise a peripheral shape having a plurality of evenly-spaced rounded bumps protruding from said one edge adjacent said graphics, each of said rounded bumps surrounding one of said binder rings.

2. The notepad of claim 1 wherein the dry-erase surface comprises a polymer film from the group of materials including polycarbonate, polyethylene, and polyethylene-terephthalate.

3. The notepad of claim 2 wherein the thermoplastic rubber is from the group including styrene thermoplastic elastomer, styrene-butadiene-styrene block copolymer, and styrene-ethylene-butadiene-styrene block copolymer.

4. The notepad of claim 3 wherein the impregnating oil is from the group including hydrogenated naphthenic oil, mineral oil, and a combination of hydrogenated naphthenic oil and mineral oil.

5. The notepad of claim 4 wherein the adhesive layer comprises one-hundred parts thermoplastic rubber by weight, one-hundred to three-hundred parts hydrogenated naphthenic oil by weight, one-hundred to three-hundred parts mineral oil by weight, less than ten parts petroleum tackifier resin by weight, and one to five parts polypropylene resin by weight.

6. The notepad of claim 1 wherein the thy-erase surface comprises a polymer film from the group of materials including polycarbonate, polyethylene, and polyethylene-terephthalate.

7. The notepad of claim 6 wherein the thermoplastic rubber is from the group including styrene thermoplastic elastomer, styrene-butadiene-styrene block copolymer, and styrene-ethylene-butadiene-styrene block copolymer.

8. The notepad of claim 7 wherein the impregnating oil is from the group including hydrogenated naphthenic oil, mineral oil, and a combination of hydrogenated naphthenic oil and mineral oil.

9. The notepad of claim 8 wherein the adhesive layer comprises one-hundred parts thermoplastic rubber by weight, one-hundred to three-hundred parts hydrogenated naphthenic oil by weight, one-hundred to three-hundred parts mineral oil by weight, less than ten parts petroleum tackifier resin by weight, and one to five parts polypropylene resin by weight.

10. The notepad of claim 1 wherein the thermoplastic rubber is from the group including styrene thermoplastic elastomer, styrene-butadiene-styrene block copolymer, and styrene-ethylene-butadiene-styrene block copolymer.

11. The notepad of claim 10 wherein the impregnating oil is from the group including hydrogenated naphthenic oil, mineral oil, and a combination of hydrogenated naphthenic oil and mineral oil.

12. The notepad of claim 11 wherein the adhesive layer comprises one-hundred parts thermoplastic rubber by weight, one-hundred to three-hundred parts hydrogenated naphthenic oil by weight, one-hundred to three-hundred parts mineral oil by weight, less than ten parts petroleum tackifier resin by weight, and one to five parts polypropylene resin by weight.

13. The notepad of claim 1 wherein the impregnating oil is from the group including hydrogenated naphthenic oil, mineral oil, and a combination of hydrogenated naphthenic oil and mineral oil.

14. The notepad of claim 13 wherein the adhesive layer comprises one-hundred parts thermoplastic rubber by weight, one-hundred to three-hundred parts hydrogenated naphthenic oil by weight, one-hundred to three-hundred parts mineral oil by weight, less than ten parts petroleum tackifier resin by weight, and one to five parts polypropylene resin by weight.

15. A flexible adhesive notepad comprising:

a tacky elastomeric layer comprised of a naphthenic oil-impregnated thermoplastic rubber having a thickness from 0.5 mm to 2.0 mm;

a face layer comprised of a polymer film permanently adhered to the elastomeric layer by an oil-based adhesive;

wherein the face layer comprises graphics which indicate a plurality of evenly spaced holes adjacent one edge thereof and which indicate a plurality of binder rings inserted through said holes to emulate a bound notebook; and the tacky elastomeric and face layers together comprise a peripheral shape having a plurality of evenly-spaced rounded bumps protruding from said one edge adjacent said graphics, each of said rounded bumps surrounding one of said binder rings.

16. A flexible adhesive notepad comprising:

a tacky elastomeric layer comprised of a naphthenic oil-impregnated thermoplastic rubber having a thickness from 0.5 mm to 2.0 mm;

a face layer comprised of a polymer film permanently adhered to the elastomeric layer by an oil-based adhesive;

wherein the face layer comprises graphics of a binding along one edge thereof to emulate a bound notebook; and the tacky elastomeric and face layers together comprise a peripheral shape having a plurality of evenly-spaced rounded bumps protruding from said one edge adjacent said graphics, each of said rounded bumps surrounding one of said binder rings.

* * * * *